United States Patent [19]

Rochat

[11] 4,015,418

[45] Apr. 5, 1977

[54] TIMEPIECE WITH DIGITAL TIME DISPLAY

[75] Inventor: Daniel-François Rochat, Neuchatel, Switzerland

[73] Assignee: Ebauches S.A., Neuchatel, Switzerland

[22] Filed: Sept. 22, 1975

[21] Appl. No.: 615,352

[30] Foreign Application Priority Data

Oct. 15, 1974 Switzerland ..... 13789/74

[52] U.S. Cl. ..... 58/23 R; 58/50 R; 58/89; 58/127 R

[51] Int. Cl.² ..... G04C 3/00; G04B 19/00; G04B 37/00

[58] Field of Search ..... 58/23 R, 50 R, 50–55, 58/88 R, 88 E, 88 G, 89, 90, 127 R

[56] References Cited

UNITED STATES PATENTS

| | | | |
|---|---|---|---|
| 2,509,428 | 5/1950 | Green | 58/56 |
| 3,025,662 | 3/1962 | Fleishman et al. | 58/50 R |
| 3,611,704 | 10/1971 | Guintos | 58/4 R |
| 3,841,083 | 10/1973 | Bergey | 58/50 R |

*Primary Examiner*—E. S. Jackmon
*Attorney, Agent, or Firm*—St. Onge Mayers Steward & Reens

[57] ABSTRACT

A timepiece having a casing provided with a lateral window, opening on its lateral face, in which appear the indications of a display device, the casing being arranged in such a way as to be capable of occupying two different positions, in which opposite faces of the casing are turned over one with respect to the other. In each position one or the other of said opposite faces is visible, and commutation means are provided for ensuring that, in one of the said positions of the casing, the time indications are displayed in one direction while, in the other position of the casing, they are displayed in the opposite direction, so that the reading of the time can be effected in either of said positions of the casing.

14 Claims, 9 Drawing Figures

TIMEPIECE WITH DIGITAL TIME DISPLAY

DETAILED DESCRIPTION OF THE PREFERRED EMBODIMENTS

The drawing shows, by way of example, three embodiments of the invention.

Figure 4:
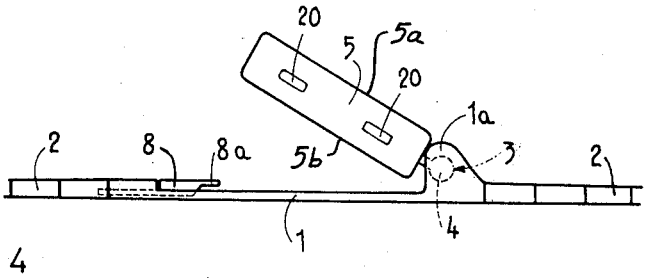

The wrist-watch as represented in FIGS. 1 through 4 comprises a rectangular plate 1, constituting a support, along the two small sides of which are arranged the two parts 2 of the wristlet. This plate 1 is provided with a thickening 1a extending transversally in which is provided a spherical recess 3 receiving a ball member 4 carried by the casing 5 of the watch, which casing encloses an electronic keep-timer controlling a time display device the indications of which (designated by 6) appear through a window 7 provided laterally in the casing 5. Since the casing 5 is supported at one end by the ball-joint 3, 4, it can be swung outward away from plate 1 as illustrated in FIG. 4 and can also be turned over about the axis of the stem on which ball 4 is mounted. Casing 5, which in this instance is rectangular, is provided with opposite faces 5*a* and 5*b*, as well as an intermediate lateral wall 5*c* in which window 7 is provided.

The plate 1 carries a small plate 8, constituting a locking member which is movable longitudinally on this plate and is provided with two fingers 8*a* engaging one or the other of two pairs of recesses 9 provided in the lateral wall of the casing 5 in which is provided the reading window 7.

Owing to the arrangement as disclosed, when the locking member 8 is away from the casing, this latter can be lifted and then by twisting it on ball member 4, brought into one or the other of two positions, in each of which one of its faces 5*a* or 5*b* is situated opposite the supporting plate 1, so that the other face is visible. The locking member 8 is then brought back into its working position in which its fingers 8*a* are engaged in one or the other of the pairs of recesses 9, thereby maintaining the casing 5 in place on the support 1.

Figure 1:
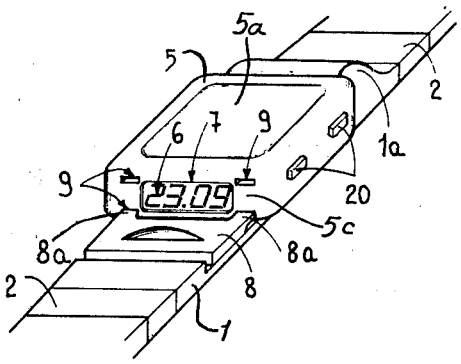
FIG. 1 is a perspective view of a first embodiment of an electronic wrist-watch having a digital time display.
Figure 2:
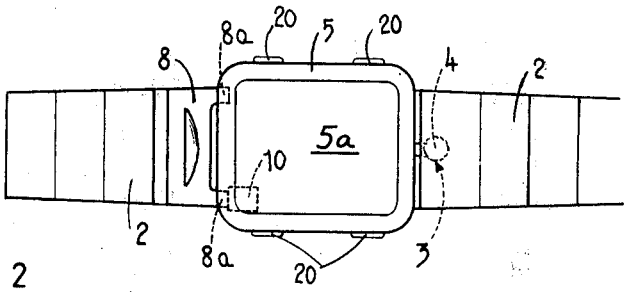
FIG. 2 is a top plan view thereof.
Figure 3:
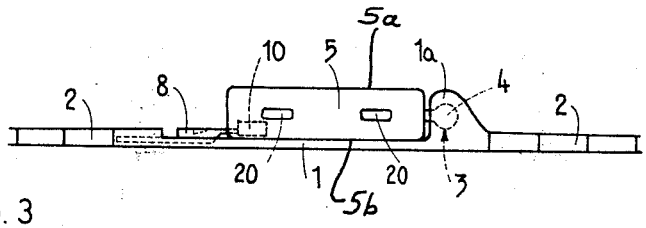
FIGS. 3 and 4 are elevational views of this watch, in two different positions.

So that the indications 6 of the time can be read whatever the position occupied by the casing 5 on the support 1 may be, the watch comprises a commutation device, diagrammatically represented at 10 in FIG. 2, which is located opposite one of the recesses 9 of the casing and which, this way, is operated by one of the fingers 8*a* of the locking member 8 when the casing occupies one of its two positions on the support 1 and which is not operated when the casing occupies its second position. This commutation device produces the change of the direction in which the indications 6 are displayed, so that they can be read from the left side to the right side in the two positions of the casing.

Figure 5:
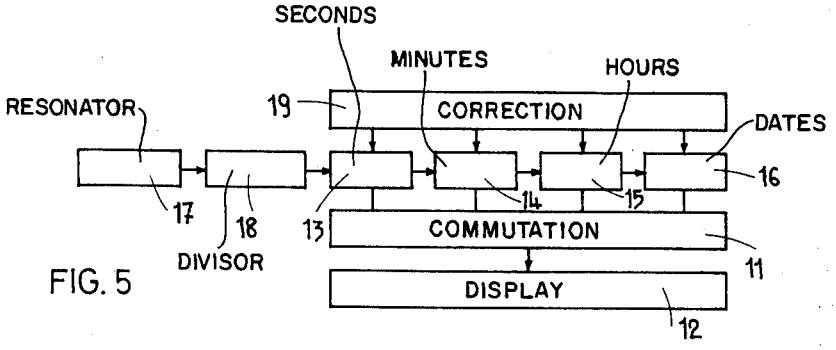
FIG. 5 is a block diagram of the circuit of this watch.

The diagram of FIG. 5 shows that the commutation device, represented by the block designated by 11, is located between the display device (block 12) and the stages of seconds (block 13), of minutes (block 14), of hours (block 15) and of the date (block 16) of the chain of division, the resonator of which is represented by the block 17 and the divisor by the block 18. The block 19 indicates the correction means which act on the stages of seconds, of minutes, of hours and of the date. The correction is operated by means of push-members 20 with which the watch is provided. These push-members are situated on the two longitudinal lateral faces of the casing.

As a modification, it is possible to provide a case in which the commutation device 10 will comprise a contact, one of the elements of which will be carried by the ball member 4 and the other one by the portion 1*a* of the support, the arrangement being such that contact is established when the casing occupies one of its positions and is interrupted in the other position.

Owing to the arrangement as disclosed and represented, one or the other the two faces 5*a*, 5*b* of the casing 5, which are not occupied by the means for displaying the time, can be made visible, according to the position occupied by the casing, and can be used for any purpose. For instance, if the casing 5 includes, in addition to the electronic movement of the watch, elements of an electronic computer, the results of the calculation can be displayed on either one or both of the faces 5*a*, 5*b*. Furthermore, the push-members of the said computer can be placed on these faces. The usable surface is thus doubled as compared to what it would be if the casing were not capable of being turned over.

Figure 6:
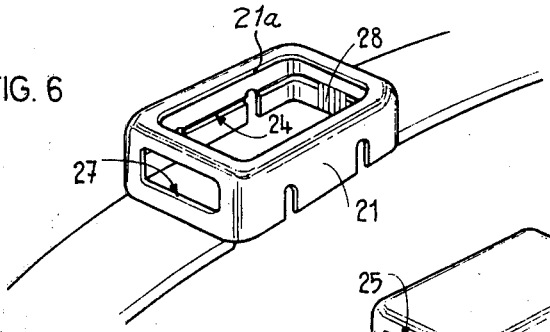
FIG. 6 is a perspective view of a portion of a second embodiment of an electronic wrist-watch.
Figure 7:
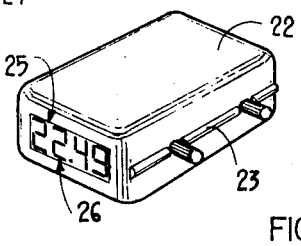
FIG. 7 is a perspective view of another portion of the wrist-watch shown in FIG. 6.

In the embodiment of FIGS. 6 and 7, the watch comprises a frame 21, of rectangular shape, along the short sides of which are secured the two parts of the wristlet.

The casing of the watch, designated by 22, of the same rectangular shape as the frame 21, can be placed inside frame 21 through the open bottom of the frame, with either of the large faces of casing 22 facing upward through an opening 21*a*. Casing 22 is provided with a ridge 23 surrounding it on three of its sides. Ridge 23 engages a corresponding groove 24 provided on the inner side of the walls of the frame 21, in order to hold the casing 22 in the frame. The lateral face of the casing is pierced, along one of its short sides, with a rectangular window 25 through which appear the indications 26 of the display device of the watch. This window 25 coincides with a corresponding opening 27 provided in the frame 20.

On the inner side of one wall of the frame is provided a contact zone 28 with which cooperates, in one of the two positions of the casing in the frame with a corresponding contact zone carried by the casing 22 not visible in the drawing, these contact zones belonging to a commutation device for changing the sense of the display of the indications 26, so that the indications are readable in either of the two positions that the casing 22 can be placed in the frame 21.

Figure 8:
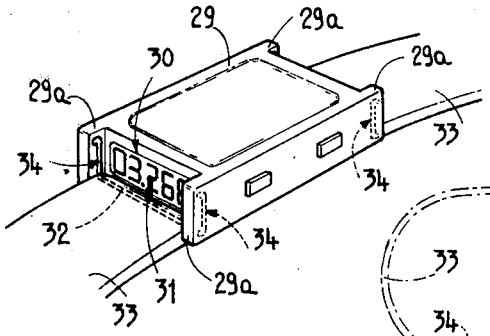
FIG. 8 is a perspective view of a third embodiment of an electronic wrist-watch.
Figure 9:
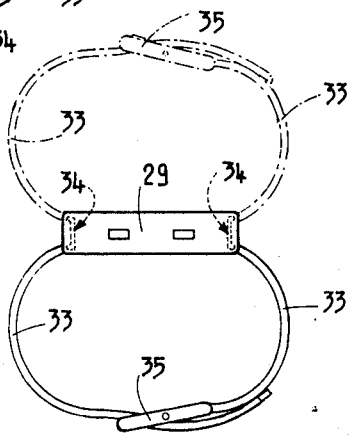
FIG. 9 is an elevational view thereof, on a smaller larger scale.

In the embodiment of FIGS. 8 and 9, the casing of the watch, designated by 29, is pierced laterally with a window 30 in which appear the indications 31 of the time. This casing is provided with two pairs of horns 29*a* to which are secured, by means of small bars 32, the two parts 33 of a wristlet. Grooves 34, extending perpendicular to the plane of the casing, are provided in the inner surfaces of horns 29*a* to receive the ends of fastening bars 32, such that each part 33 of the wristlet can slide from one extremity to the other of its corresponding groove. The clasp of the wristlet, designated by 35 in FIG. 9, is reversible in that it is arranged in such a way as to be capable of being operated from outside the loop formed by the wristlet, whichever face of the wristlet is turned towards the inside of such loop. This arrangement makes it possible to strap the watch onto the wrist in either of the two positions represented in FIG. 9, one in plain lines and the other in dot-and-dash lines, in which one or the other of its two faces, respectively, is turned outwardly. In one of these positions, the ends of the small bars 32 for securing the wristlet 33 are situated in the vicinity of one of the ends of the two pairs of grooves 34 while, in the other of these two positions, they are situated in the vicinity of the other end of these grooves.

A commutation device (not shown) for sense of the display of the indications 31 comprises contact means operated by one of the ends of one of the small bars 32 when it is located in one of its two operating positions only, so that the commutation is operated when the watch is changed from one of its positions of use into the other one.

What I claim is:

1. A timepiece having a digital time display comprising a casing having two opposite faces and a lateral wall intermediate said opposite faces, a lateral window opening through said lateral wall in which appear the indications of the display device, said casing being arranged in such a way as to be capable of occupying two different positions wherein said opposite faces are turned over, one with respect to the other, in each of which positions one or the other of said opposite faces is visible, commutation means ensuring that in one of the said positions of the casing the time indications are displayed in one direction, while in the other position of the casing they are displayed in the opposite direction, so that the reading of the time can be effected in either of said positions of the casing.

2. Timepiece as claimed in claim 1, characterized by the fact that the said commutation means comprises a contact device operated in one of the two positions of the casing.

3. A timepiece as claimed in claim 1, which further includes a support on which the casing is mounted so as to be able to occupy, with respect to said support, its two said positions.

4. A timepiece as claimed in claim 3, which further includes a wristlet rigidly secured to said support.

5. A timepiece as claimed in claim 3, which further includes a ball-joint connecting said casing to said support whereby said casing can be lifted and turned over on said support.

6. A timepiece as claimed in claim 5, which further includes a contact device comprising a pair of elements, one carried by said ball member and the other one by said support, such that said contact device is closed in one of the two positions of the casing on the support and open in the other one.

7. A timepiece as claimed in claim 5, wherein said support carries a locking member engaging the casing so as to maintain it in place on the said support.

8. A timepiece as claimed in claim 3, characterized by the fact that said casing is mounted removably on its support, and which further includes means for securing said casing to said support in one or the other of its two positions.

9. A timepiece as claimed in claim 8, characterized by the fact that said support comprises a frame within which said casing is supported, said frame being pierced with an opening coinciding with said lateral window of the casing when said casing is in place in said frame in one or the other of its two positions.

10. A timepiece as claimed in claim 8, which further includes a contact device comprising a pair of elements, one carried by said casing and the other one by said support, such that said contact device is closed in one of the two positions of the casing on the support and open in the other one.

11. A timepiece as claimed in claim 1, which further includes a wristlet and means for securing said wristlet to said casing such that each end of said wristlet where it is attached to said casing can slide with respect thereto in a direction perpendicular to the plane of said casing, so as to be able to be bound to said casing substantially in the plane of one or the other of said two opposite faces according to the position of the casing in which the timepiece is used.

12. A timepiece as claimed in claim 11, wherein said wristlet-securing means comprises two pairs of horns in each of which is provided a groove directed perpendicularly to the plane of the casing, said grooves receiving the ends of small bars for securing the wristlet.

13. A timepiece as claimed in claim 12, which further includes a contact device mounted for operation by one of said small bars.

14. A timepiece as claimed in claim 11, wherein said wristlet consists of two parts which can be joined by a clasp capable of being operated from the outside of the loop formed by said wristlet whichever face of the wristlet is turned towards the inside of said loop.

* * * * *